United States Patent [19]

Moldovan

[11] Patent Number: 4,814,739

[45] Date of Patent: Mar. 21, 1989

[54] COMBINATION PUSH/PULL ELECTRIC SWITCH AND CIRCUIT BREAKER

[75] Inventor: Peter K. Moldovan, Cascade, Wis.

[73] Assignee: Eaton Corporation, Cleveland, Ohio

[21] Appl. No.: 134,800

[22] Filed: Dec. 18, 1987

[51] Int. Cl.[4] ..... H01H 71/16

[52] U.S. Cl. ..... 337/68; 337/66

[58] Field of Search ..... 337/68, 66, 56, 79, 337/91, 43

[56] References Cited

U.S. PATENT DOCUMENTS

| | | | |
|---|---|---|---|
| 3,386,061 | 5/1968 | Delafrange | 337/68 |
| 4,528,538 | 7/1985 | Andersen | 337/43 |
| 4,630,020 | 12/1986 | Yang | 337/79 |

*Primary Examiner*—H. Broome

*Attorney, Agent, or Firm*—James E. Nilles; Thomas F. Kirby

[57] ABSTRACT

The insulating housing of the device supports two spaced-apart stationary terminal/contact assemblies. A resilient, thermally-responsive, snap-acting, movable contact support member, which has a movable contact and a cam-follower thereon, is connected at one end to one assembly and is movable to three positions relative to a stationary contact on the other assembly, namely: a contact-closed position wherein the movable contact engages the stationary contact, a contact-open position and a contact-tripped position. An outwardly projecting rod-like actuator slidable on the housing, and which has a cam on its inner end, is axially movable inwardly and outwardly between an "on" switch-closed/breaker-reset position and an "off" switch-open/breaker-tripped position (wherein it is biased by a spring), respectively. In actuator "off" position, the cam blocks the contact support member and prevents the movable contact from closing. When the actuator is manually depressed to "on" position, the cam unblocks the contact support member and allows it to move to contact-closed position wherein it engages the cam and holds the actuator in "on" position. When the actuator is manually pulled to "off" position, the cam engages the cam follower, forces the contact support member to contact-open position and blocks it against closure. If an overload occurs, the contact support member heats up and snaps to tripped position thereby opening the contacts and disengaging itself from the cam and allowing the actuator to be biased to "off" position.

14 Claims, 4 Drawing Sheets

COMBINATION PUSH/PULL ELECTRIC SWITCH AND CIRCUIT BREAKER

BACKGROUND OF THE INVENTION

1. Field of Use

This invention relates to a combined push/pull electric switch and circuit breaker device which is especially well adapted for use in power supply units but could have other uses.

2. Description of the Prior Art

Electrical power supply units called "power strips" are typically used to supply a plurality of electrical devices with electrical power from a conventional single wall-mounted plug-in outlet or receptacle. A typical power strip comprises a housing, a plurality of individual plug-in receptacles mounted on the housing and electrically connected in parallel with each other, a two (or three) conductor line cord having a male plug at its remote end for connection to a conventional wall-mounted receptacle, and a combined on/off electric switch and an overload-responsive circuit breaker device mounted in the housing and electrically connected between the line cord and the plurality of receptacles on the housing. The combined switch/circuit breaker enables the power strip receptacles to be turned on and off as desired and to be turned off automatically in the case of an overload or power surge.

One prior art combined switch/circuit breaker device comprises a manually operable switch actuator which has on/off positions and a small "status light", such as a diode or bulb associated therewith, which, when illuminated, visually indicates that the actuator is in "on" position, that the combined switch/circuit breaker device is closed and that the power strip receptacles are energized. When the status light is not illuminated, the indication is that the power strip receptacles are de-energized, and the position of the rocker switch actuator (off or on) indicates, respectively, that the switch is open or that the circuit breaker has tripped.

It is desirable to provide an improved combined switch/circuit breaker device which is simpler and less costly than, but just as useful and reliable as, prior art devices.

SUMMARY OF THE INVENTION

A combined push/pull electric switch and thermally responsive circuit breaker device in accordance with the invention comprises a two-piece snap-together insulated housing in which are mounted two spaced apart stationary terminal/contact assemblies, each adapted for press-in connection to a power supply lead and one having a stationary contact thereon, and a thermally responsive resilient snap-acting three-position (closed, open, tripped) movable contact support member connected to the other terminal/contact assembly and having a movable contact thereon for bridging the stationary terminal/contact assemblies. An actuator member slidably mounted in the housing and projecting therefrom is movable between an outwardly extended switch-open position, toward which it is spring-biased by a biasing spring, and an inwardly-depressed switch-closed position. The inner end of the actuator member comprises a cam to effect movement of the movable contact support member between open and closed positions wherein the movable contact and stationary contact open and close, respectively, and to releasably engage the movable contact support member to maintain the actuator member in switch-closed position. In operation, when the actuator member is in switch-open position and the movable contact support member is at ambient temperature, the cam engages the movable contact support member and maintains it in open position. When the actuator member is manually depressed to switch-closed position and the movable contact support member is at ambient temperature, the cam allows the movable contact support member to close. The closed movable contact support member also engages the cam to maintain the actuator member in switch-closed position. When the actuator member is manually pulled toward switch-open position, the cam raises the movable contact to open position, releases the movable contact support member from engagement with the cam and enables the actuator member to be manually moved into switch-open position wherein it remains biased. When the movable contact support member, while in closed position, is heated by an electrical overload, it bends and then snaps to tripped position and disengages from the cam, thereby allowing the actuator member to be spring-biased to switch-open position wherein it remains until manually reset. Whenever the actuator member is in switch-open position, it blocks the movable contact support member from assuming switch-closed position.

A combined push/pull electric switch and thermally responsive circuit breaker device in accordance with the invention offers several advantages over the prior art. For example, it employs a minimum number of component parts which are relatively easy and economical to fabricate and assemble. The device, is relatively simple, straightforward and compact in design, and is reliable in use. The device performs the same switching and circuit-breaking functions of generally similar prior art devices, but eliminates certain component parts found in prior art devices, such as the status indicator light and circuitry therefor. The inventive device relies instead on actuator member position (inward or outward) to visually indicate that the switch is open. Furthermore, the actuator member, when in open position, positively blocks the movable contact support member against accidental reclosure after having tripped and as it changes its shape while cooling to move back toward closed position. The movable contact support member, when in closed position, positively blocks the actuator member and prevents it from being unintentionally moved to switch-open position. The snap-action configuration of the movable contact support member ensures rapid and positive tripping motion in response to an overload condition and also ensures rapid and positive return toward its untripped configuration. All components, except the movable contact support member, are secured to the housing by entrapment and the device itself is secured by entrapment in the electrical unit in which it is used, thereby eliminating the need for fasteners and installation time and labor. Other objects and advantages of the invention will hereinafter appear.

DRAWINGS

DESCRIPTION OF A PREFERRED EMBODIMENT

Figure 1:
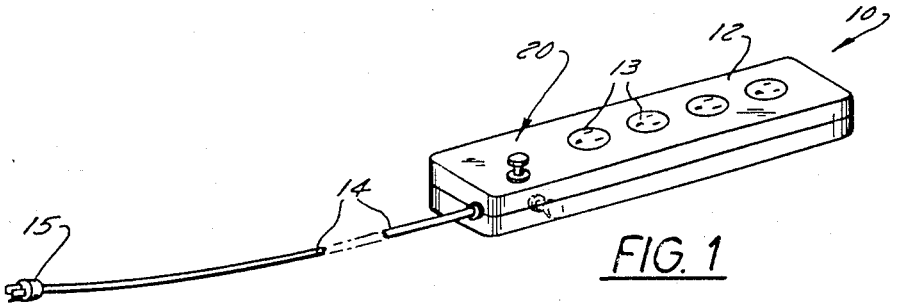
FIG. 1 is a perspective view of a power strip unit employing a combined push/pull electric switch and thermally responsive circuit breaker device in accordance with the invention.

FIG. 1 shows a power strip 10 which is used to supply a plurality of electrical devices (not shown) with electrical power from a conventional single wall mounted plug-in outlet or receptacle (not shown). Power strip 10 comprises a two-piece housing 12, a plurality of individual plug-in receptacles 13 mounted on the housing and electrically connected in parallel with each other, a two (or three) conductor line cord 14 having a male plug 15 at its remote end for connection to the wall receptacle (not shown), and a combined push/pull electric switch and thermally responsive circuit breaker device 20 in accordance with the invention and mounted in housing 12 and understood to be electrically connected between line cord 14 and the plurality of receptacles 13 on housing 12. In FIG. 1, device 20 is shown in solid lines as mounted for access from the top of housing 12 but, alternately, could be side-mounted as shown in dotted lines in FIG. 1. Device 20 enables the power-strip receptacles 13 to be turned on and off as desired and to be turned off automatically in the case of an overload.

As FIGS. 1, 8, 10 and 11 show, device 20 is secured in power strip housing 12 by entrapment between the strip housing walls 12A and 12B (see FIG. 8), by a rigid post 12C affixed to a wall 12D in housing 12 which extends into a post recess 21 formed in device 20 (see FIG. 11), and by a circular hole 12E in a wall 12F in strip housing 12 (see FIGS. 10 and 11) which receives a cylindrical neck 23 formed on device 20. Device 20 may be assigned a suitable location and orientation in power strip housing 12 other than those shown in FIG. 1.

Figure 2:
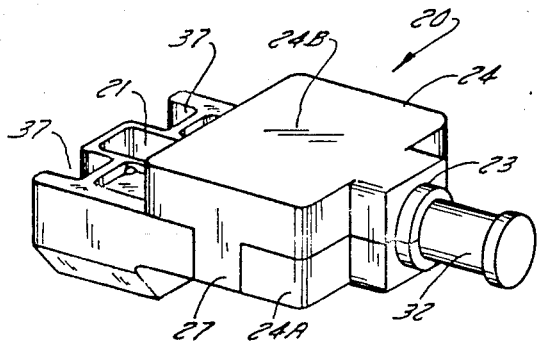
FIGS. 2 and 3 are perspective views of the device removed from the power strip unit and are taken from the front and rear ends, respectively.
Figure 3:
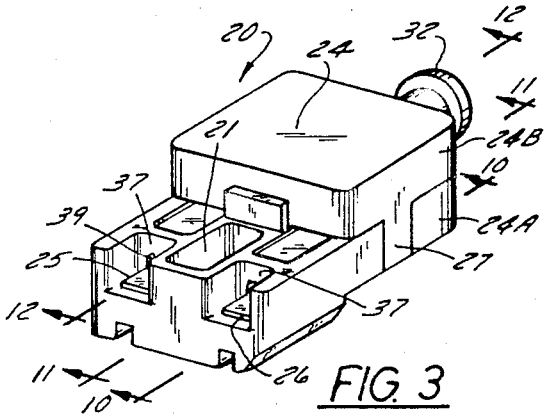
Figure 4:
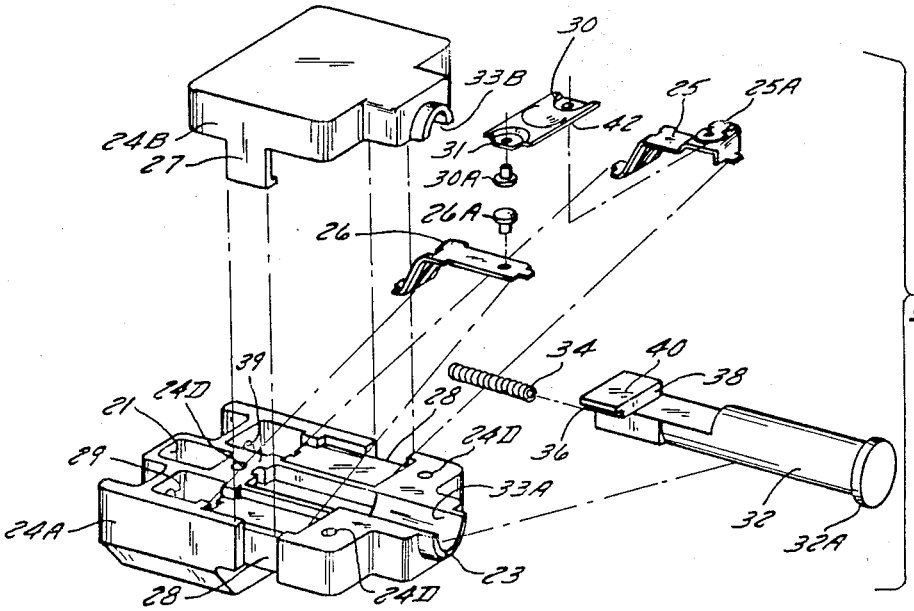
FIG. 4 is an exploded view of the device showing the several component parts thereof.
Figure 6:
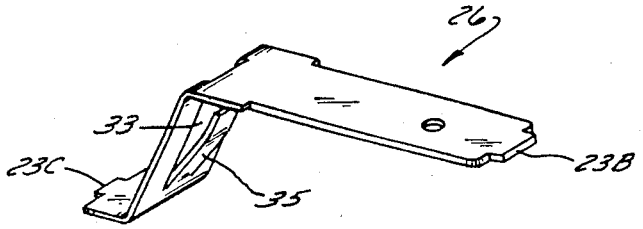
FIGS. 5 and 6 are enlarged perspective views of the stationary terminal contact assemblies of FIG. 4.
Figure 7:
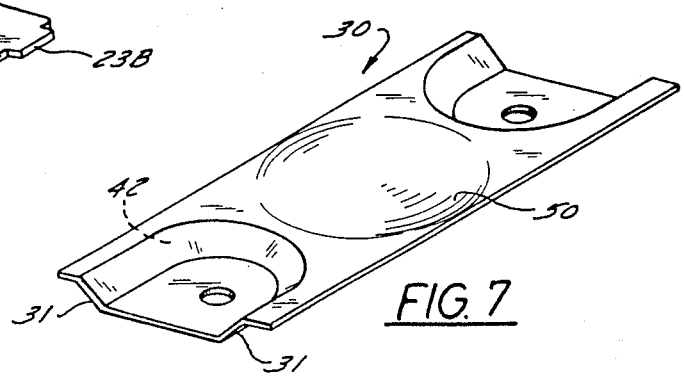
FIG. 7 is an enlarged perspective view of the thermally responsive snap-acting movable contact support member of FIG. 4.
Figure 5:
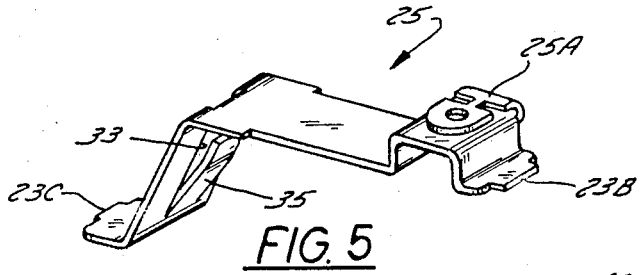

Referring to FIGS. 2, 3 and 4, device 20 is a combination trip-free, thermally responsive overload protection circuit breaker and a push/pull operated switching device. Device 20 generally comprises support means in the form of an insulating housing 24 having a bottom or base member 24A and a top or cover member 24B, a first stationary terminal/contact assembly 25 which also serves as a mounting buss for a thermally responsive resilient snap-acting movable contact support member 30, a second stationary terminal/contact assembly 26 engageable by movable contact support member 30, a push/pull axially movable manual operating lever or actuating member 32, and a drive spring or biasing spring 34.

Figure 8:
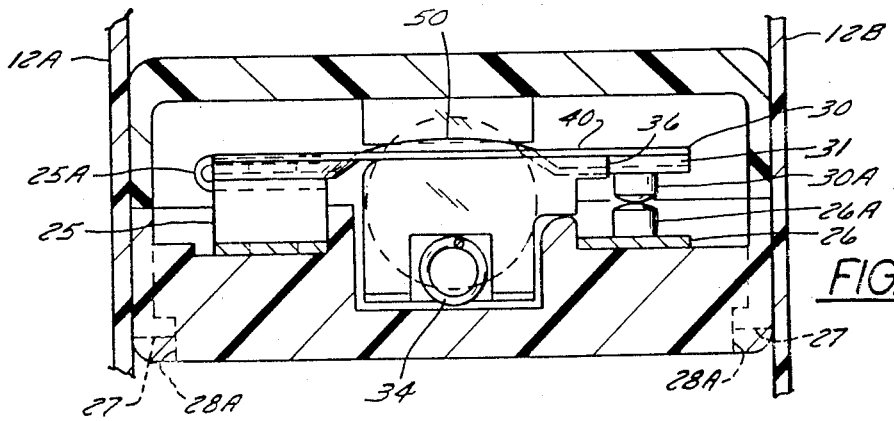
FIG. 8 is an enlarged cross-sectional view of the device taken on line 8—8 of FIG. 11 and shows the movable contact support member in closed position.
Figure 10:
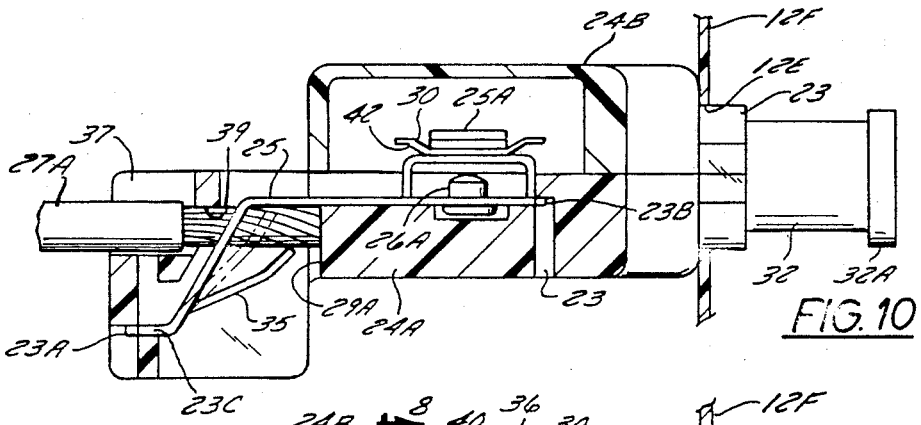
FIGS. 10, 11 and 12 are cross-sectional views of the device taken on correspondingly-numbered lines in FIG. 3 and show the movable contact support member in open position.

As FIGS. 4 and 8 best show, in housing 24, which serves as the support for all components of device 20, cover member 24B readily aligns and interlocks with base member 24A in snap-together relationship by means of three guide holes 24D (see FIG. 4) and two resiliently flexible locking tabs 27 on cover member 24B which engage alignment studs (not visible) and grooves 28, respectively, formed in base member 24A. Each tab 27 has a flange at its lower end which releasably grips a shoulder 28A at the lower end of a groove 28 (see FIG. 8). Each terminal/contact assembly 25 and 26 snaps into openings 23 and 23A (see FIG. 10) in base member 24A by means of two locking tabs 23B and 23C, respectively, located at the opposite ends of each terminal/-contact assembly 25, 26, as FIG. 10 shows. The two spaced apart stationary terminal/contact assemblies 25 and 26, which are mounted within housing 24, but are accessible from the exterior thereof, and are adapted for press-in connection to power supply wire leads 27A and 28A shown in FIGS. 10 and 12, respectively. As FIGS. 5, 6, 10 and 12 show, each terminal/contact assembly 25, 26 has releasable wire insertion/locking means, including a hole 33, that allows easy insertion of the external connection wires 27A, 28A and locking of a wire to its terminal is accomplished by means of a resiliently movable locking tab 35 (compare FIGS. 10 and 12). The wires 27A, 28A are guided to the holes 33 and the locking tabs 35 and are prevented from accidentally shorting to each other by means of separated wire guide openings 37 (see FIG. 3) and orientation retention slots 39 in base member 24A (see FIGS. 10 and 12). The shape and orientation of the locking tabs 35 prevent accidental pullout of the externally inserted conductor wires 27A, 28A from a terminal/contact assembly 25, 26, respectively. A groove 29A (FIGS. 4 and 11) prevents sideward movement of wires 27A, 28A.

Figure 9:
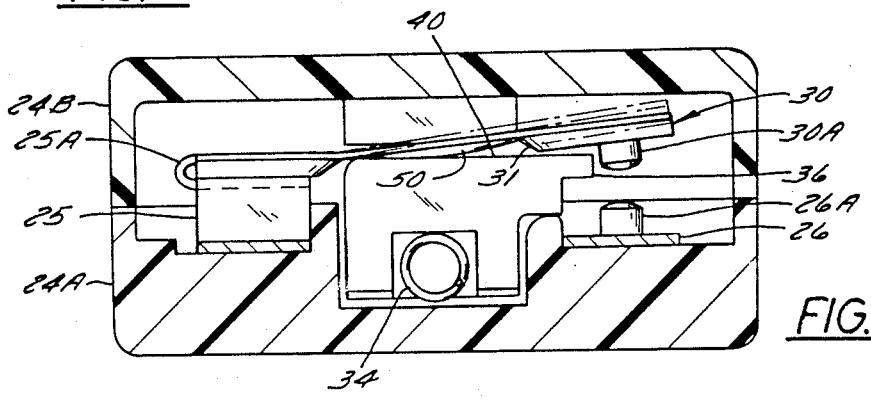
FIG. 9 is a view similar to FIG. 8 but shows two other operating positions of the movable contact support member.

Referring to FIGS. 4, 5, 6, 7, 8 and 9, thermally responsive movable resilient snap-acting three-position (closed, open, tripped) contact support member 30 is provided for bridging the stationary terminal/contact assemblies 25 and 26 and is mechanically and electrically connected at one end to terminal/contact assembly 25 (see FIGS. 4, 8 and 9). Contact support member 30 comprises a snap-acting circular bulged portion 50 and a contoured portion at its free end which defines a cam follower member 31 on the underside of contact support member 30. The aforesaid three positions ar depicted in FIG. 8 (contact closed) and in FIG. 9 (contact open) in solid lines and (contact tripped) in dotted lines. More specifically, referring to FIGS. 7, 8 and 9, when movable bimetallic contact support member 30 is at ambient temperature, it assumes a flat, contact-closed position (FIG. 8) and the snap-acting circular portion 50 thereof bulges convexly upwardly. When contact support member 30 is still at ambient temperature but is mechanically moved upwardly to contact-open position (FIG. 9, solid lines) by actuator 32, it bends upwardly, but circular portion 50 still bulges convexly upwardly. However, when contact support member 30 is heated beyond a specific selected temperature due to an electrical overload, contact support member 30 starts to bend upwardly from closed position (FIG. 8) toward open position (FIG. 9, solid lines)

but, then, circular portion 50 snaps from upwardly convex condition to downwardly convex condition (as shown in FIG. 9) to quickly move contact support member 30 to the tripped position shown in FIG. 9. After tripping, contact support member 30 cools back down toward ambient temperature and, at a certain temperature, circular portion 50 snaps back from downwardly convex condition to upwardly convex condition.

As FIGS. 4 and 8 show, terminal/contact assembly 26 has a contact 26A attached thereto which serves as the stationary contact for circuit protection and for the switching function. The bimetal movable contact support member 30, which is of snap-action design, has a contact 30A attached to it at one end, and its other end is mounted on terminal/contact assembly 25. Terminal/contact assembly 25 has a bimetal mounting and orientation tab 25A that facilitates attachment of contact 30 to terminal/contact 25 and maintains proper orientation of a cam follower surface 31 (FIG. 7) relative to a cam 36 on actuator member 32, hereinafter described, to assure good switching action and lever locking. Movable contact support member 30 performs the dual function of providing thermal overload protection and movable switching control in device 20.

Figure 13:
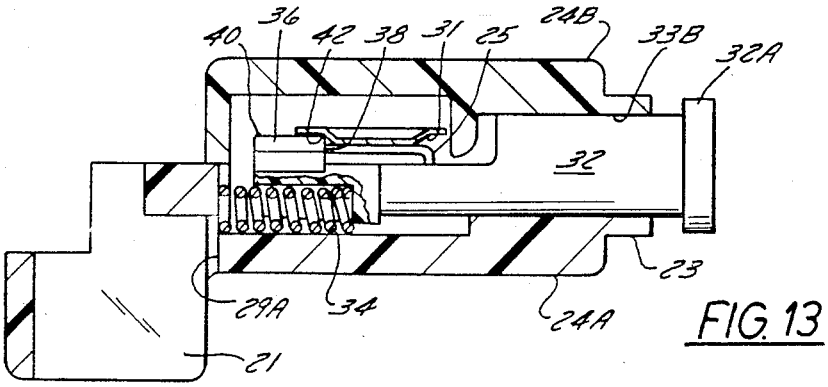
FIG. 13 is an enlarged cross-sectional view of the device similar to FIG. 11 but showing the component parts thereof in switch-closed condition.

Actuator member 32, shown in detail in FIGS. 4 and 8 through 13, is slidably mounted in a bore 33 formed in housing 24 by mating depressions 33A and 33B formed in members 24A and 24B, respectively, and projects therefrom. Actuator member 32 is axially movable between an outwardly extended switch-open position (FIGS. 2, 9, 10, 11 and 12), toward which it is spring-biased by spring 34, and an inwardly-depressed, switch-closed position (FIGS. 8 and 13) to which it is manually depressed. The inner end of actuator member 32 comprises an integrally formed cam 36 which engages contoured cam follower surface 31 on movable contact support member 30 to effect movement of movable contact support member 30 between open (FIGS. 9 and 11) and closed positions (FIGS. 8 and 13). In switch-open position, the upper flat surface 40 of cam 36 engages the underside of movable contact support member 30 and prevents its contact 30A from engaging stationary contact 26A. Cam 36 also comprises a front surface 38 which is releasably engageable with the rear edge 42 of cam follower 31 to maintain actuator member 32 in switch-closed position (FIG. 13). The cam surface 38 traps behind cam follower 31 (FIG. 13) and also operates to elevate movable contact support member 30 during push/pull lever action (FIG. 9). Actuator member 32 has a collar 32A at its outer end to facilitate manual push/pull lever manipulation.

Figure 11:
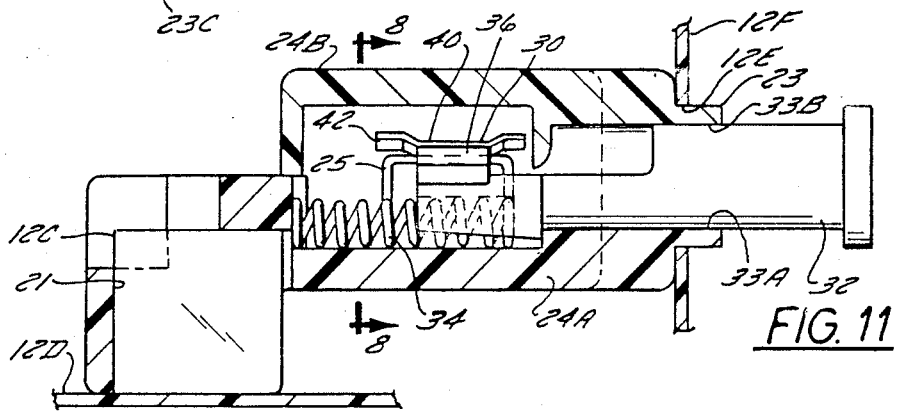
Figure 12:
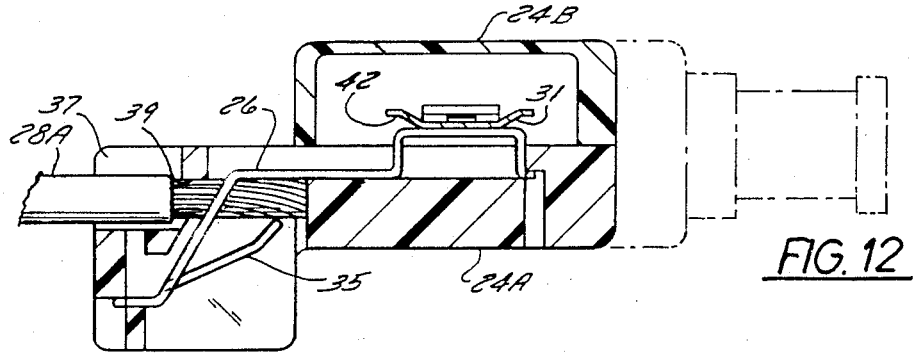

Biasing spring 34 pushes actuator member 32 forward to off position when the bimetallic contact support member 30 snaps up during an overload protection function of device 10, thus providing a visual indication of tripped condition (compare FIGS. 13 and 11.

OPERATION

In operation, as FIGS. 9 and 11 show, when actuator member 32 is in switch-open position and movable contact 30 is at ambient temperature, upper surface 40 of cam 36 engages the underside of movable contact support member 30 and maintains the movable contact support member in open position.

As FIGS. 8 and 13 show, when actuator member 32 is manually depressed to switch-closed position and movable contact support member 30 is at ambient temperature, upper surface 40 of cam 36 is relocated and allows movable contact support member 30 to close and enables latch surface 38 of cam 36 to engage the rear of cam 31 of movable contact support member 30 to latch or maintain actuator member 32 in switch-closed position.

As FIGS. 9, 10, 11 and 12 show, when actuator member 32 is manually pulled toward switch-open position, cam 36 tracks along contour surface 31 and raises movable contact support member 30 to open position, releases it from engagement with latch surface 38 of cam 36 and actuator member 32 is manually moved into switch-open position wherein it remains biased by spring 34. Cam surface 40 blocks contact support member 30 from re-closure. It is to be noted that cam surface 40 does not make contact with either stationary contact 26A or movable contact 30A and, therefore, does not contaminate them.

As FIG. 9 makes clear, when movable contact support member 30 is heated by an electrical overload, it snaps to tripped position (see dotted lines in FIG. 9) and disengages from cam surface 38, thereby allowing actuator member 32 to be spring-biased to switch-open position wherein it remains until manually reset.

The circuit breaker mode of device 20 is trip free in that, even if actuator 32 is manually held depressed, movable contact support member 30 will be able to snap open to tripped position to clear the fault circuit. After normal circuit breaker action, bimetal movable contact support member 30, upon cooling, does not snap back to closed position to re-initiate the fault current. The location of surface 40 of cam 36 of actuator 32 blocks contact support member 30 and prevents its contact 30A from engaging stationary contact 26A. After a fault current tripping operation, and after sufficient cooling of bimetal contact support member 30, device 20 must be manually reset by depression of actuator 32 before a circuit is again established.

The switching mode of device 20 is activated through manual manipulation (push-pull) of actuator 32. As actuator 32 is depressed, its cam 36 moves behind the bimetal contour 31, drive spring 34 is compressed, and contact 30A closes on stationary contact 26A. Actuator 32 is held in the depressed state by the engagement between the rear side of cam following 31 and the front surface 38 of cam 36. The mechanical spring action of the movable contact support member 30 blocks the forward movement of cam 36 and actuator member 32.

The movable contact 30A and the stationary contact 26A are switched "open" by manually pulling on actuator 32. As this occurs, cam 36 moves forward and is forced to interact with cam follower 31, thereby pushing the movable contact support member 30 upward and out of the way and breaking contact closure of the contacts 30A and 26A.

Figure 14:
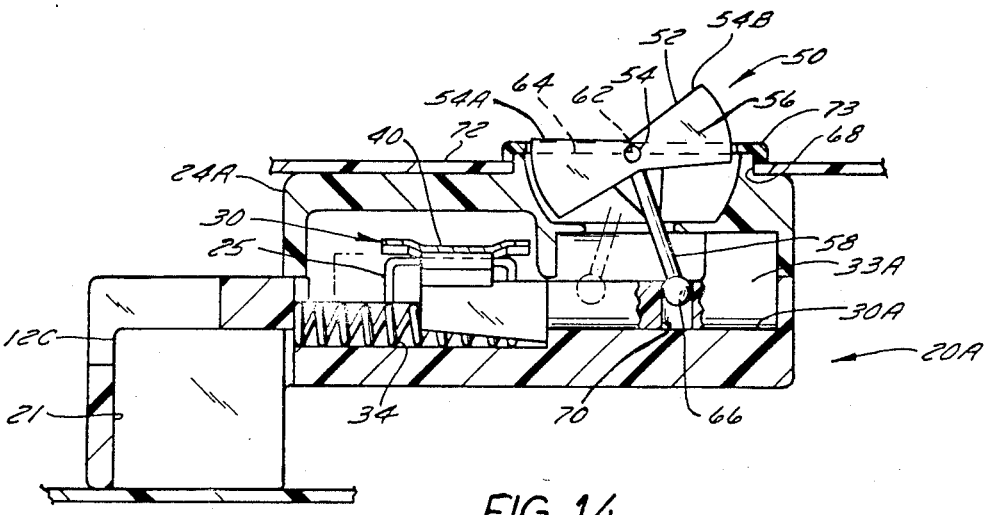
FIG. 14 is a cross-sectional view of a portion of another embodiment of the device wherein the switch actuator comprises a slidably movable rod type member and a pivotally movable rocker member which are inter-engaged.

FIG. 14 shows in cross-section a portion of an alternate embodiment of a device 20A, similar to device 20 hereinbefore described, wherein the rod type actuator member 32A is not operated directly by manual push-/pull manipulation but, instead, is operated by a rocker type actuator member 50 which, in turn, is itself manually movable pivotably to on/off positions and effects corresponding on/off axial movement of actuator member 32A. Rocker type actuator member member 50 which, for example, is fabricated by injection molding, comprises an outer side 52, a pair of integrally formed pivot pins 54 (only one pin visible) on opposite lateral sides 56 (only one side visible), and has an integrally formed projection or lever 58 on its underside 60. Each pivot pin 54 is rotatably mounted in a notch 62 in a flange 64 integrally formed on the housing 24A of device 20A. The lever 58 has a spherically-shaped tip 66 which is received in a cylindrically-shaped retaining hole 70 formed in a lateral side of actuator member 32A. Actuator member 32A is of such length that it does not project outwardly of bore 30A in which it is axially slidable. When end 54A or end 54B on outer side 52 of rocker type actuator member 50 is manually depressed, lever 58 pivots to move actuator rod 32A to closed or open position, respectively. Housing 24A is designed so as to project through a hole 68 formed in housing 72 in a unit such as unit 10 in which device 20A is mounted and aids in entrapment of the device in the unit. A retainer 73 is provided which snaps onto the outside of flanges 64 to hold device 20A in place.

I claim:

1. A combined electric switch and circuit breaker device (20) comprising:

a stationary electrical contact (26A);

a movable electrical contact (30A) engageable with said stationary contact (26A);

a resilient, thermally responsive, movable, electrically conductive, contact support member (30) on which said movable contact (30A) is mounted and electrically connected, said contact support member (30) being movable along a first path relative to said stationary contact (26A) to a contact-closed position, a contact-open position and a contact-tripped position;

an electrically non-conductive actuator (32) movable along a second path transverse to said first path between an on switch-closed/breaker-reset position and an off switch-open/breaker-tripped position;

biasing means (34) for biasing said actuator (32) to said off position;

said actuator (32) being engageable with said contact support member (30), but spaced from said contacts (26A, 30A) regardless of the position into which said contact support member (30) is moved;

and means on said actuator (32) engageable with said contact support member (30) but spaced from said contacts (26A, 30A), said means being operable:

when said actuator (32) is in off position to engage and maintain said movable contact support member (30) in contact-open position;

when said actuator (32) is manually moved to on position to engage and effect movement of said movable contact support member (30) to contact-closed position wherein said movable contact support member (30) maintains said actuator (32) in on position;

when said actuator (32) is manually moved to off position to engage and effect movement of said movable contact support member (30) to contact-open position and to block said movable contact support member (30) and prevent said movable contact (30A) from engagement with said stationary contact (26A);

said biasing means (34) being operable, when said movable contact support member (30) is heated and has moved to contact-tripped position, to move said actuator (32) to off position wherein said actuator (32) blocks said movable contact support member (30) and prevents said movable contact (30A) from engagement with said stationary contact (26A).

2. A device (20) according to claim 1 wherein said movable contact support member (30) bends when the temperature thereof is within a predetermined temperature range, and moves with a snap-action when the temperature falls below or exceeds said range.

3. A device (20) according to claim 1 comprising a pair of spaced apart stationary terminal/contact assemblies (25, 26), wherein said movable contact support member (30) is mechanically and electrically connected to one of said stationary terminal/contact assemblies (25) and carries said movable contact (30A) which is movable into and out of engagement with said stationary contact (26A) which is mounted on the other of said stationary terminal/contact assemblies (26).

4. A device (20) according to claim 1 or 2 or 3 further comprising an insulating housing (24) in which said stationary contact (26A), said movable contact (30A), contact, said actuator (32) and said biasing means (34) are mounted.

5. A device (20) according to claim 4 wherein said actuator (32) is slidably mounted on said housing (24) and is slidably engageable with said movable contact support member (30) to move the latter between contact-open and contact-closed positions.

6. A device (20) according to claim 5 wherein said movable contact support member (30) is releasably engageable with said actuator (32) to maintain the latter in on position until said movable contact support member (30) moves to said contact-tripped position.

7. A combined electric switch and circuit breaker device (20) comprising:

an insulated housing (24);

a pair of terminal/contact assemblies (25, 26) mounted on said housing (24) in spaced apart relationship;

a stationary electrical contact (26A) mounted on one of said terminal/contact assemblies (26);

a resilient thermally response movable contact support member (30) having one end connected to the other of said terminal/contact assemblies (25) and having an opposite end movable along a first path to three positions relative to said stationary contact (26A), including a closed position, an open position and a tripped position;

a movable electrical contact (30A) mounted on and movable with said opposite end of said support member (30);

said movable contact support member (30) having a cam follower (31) thereon which is spaced apart from said contacts (26A, 30A);

an electrically non-conductive actuator (32) slidably mounted on said housing (24) and slidably movable along a second path transverse to said first path between an off switch-open/breaker-tripped position and an on switch-closed/breaker-closed position;

and biasing means (34) connected between said housing (24) and said actuator (32) to bias the latter to said off position;

said actuator (32) comprising cam means (36, 40) cooperable with said cam follower (31) to effect movement of said movable contact support member (30) between said open position and closed position as said actuator (32) moves between said off position and said on position, respectively;

said cam means (36, 40) being operable to prevent movement of said moveable contact support member (30) to closed position when said actuator (32) is in said off position;

said cam follower (31) on said movable contact support member (30) being engageable with said cam means (36) when said movable contact support member (30) is in said closed position and when said actuator (32) is in said on position to maintain said actuator (32) in said on position;

said cam means (36) being disengageable from said cam follower (31) when said movable contact support member (30) moves to tripped position to enable said biasing means (34) to move said actuator (32) to off position and to maintain said actuator (32) in said off position.

8. A device (20) according to claim 7 wherein said actuator (32) projects outwardly from said housing (24) for different distances when in said on position and when in said off position to thereby provide an indication, respectively, of switch open/breaker tripped position and switch closed/breaker closed position.

9. A device (20) according to claim 7 or 8 wherein said terminal/contact assemblies (25, 26) are secured to said housing (24) by entrapment.

10. A device (20) according to claim 9 wherein each of said terminal/contact assemblies (25, 26) is adapted to have a wire lead (27A, 28A) secured thereto by entrapment.

11. A device (20) according to claim 7 or 8 wherein said housing (24) is adapted to be mounted on an electrical unit (12) by entrapment.

12. A device (20) according to claim 7 or 8 wherein said housing (24) comprises two cover portions (24A, 24B) and mean to secure said cover portions together, said means comprising a resilient tab (27) on one cover portion (24B) which engages the other cover portion (24A).

13. A device (20) according to claim 12 wherein said two cover portions (24A, 24B) have recesses (33A, 33B) therein which cooperate to define a bore (33) for slidably receiving said actuator (32)

14. A device (20) according to claim 4, wherein said actuator (32) comprises an axially movable actuator member (32A) slidably mounted on said housing (24) and a pivotally movable rocker type actuator member (50) pivotally mounted on said housing (24) and engaged with said axially movable actuator member (32A) so that movement of one effects movement of the other.

* * * * *